US009006547B2

(12) United States Patent
Martin

(10) Patent No.: US 9,006,547 B2
(45) Date of Patent: Apr. 14, 2015

(54) ACOUSTIC STRINGED INSTRUMENT BRIDGE TRUSS

(76) Inventor: Billy Frank Martin, Asheville, NC (US)

( * ) Notice: Subject to any disclaimer, the term of this patent is extended or adjusted under 35 U.S.C. 154(b) by 162 days.

(21) Appl. No.: 13/585,359

(22) Filed: Aug. 14, 2012

(65) Prior Publication Data

US 2013/0174710 A1 Jul. 11, 2013

Related U.S. Application Data

(60) Provisional application No. 61/583,514, filed on Jan. 5, 2012.

(51) Int. Cl.

| | |
|---|---|
| ***G10D 3/04*** | (2006.01) |
| ***G10D 3/02*** | (2006.01) |
| ***G10D 1/08*** | (2006.01) |

(52) U.S. Cl.
CPC ... *G10D 3/02* (2013.01); *G10D 1/08* (2013.01)

(58) Field of Classification Search
USPC ..... 84/298
See application file for complete search history.

(56) References Cited

U.S. PATENT DOCUMENTS

| | | | | |
|---|---|---|---|---|
| 4,989,491 | A * | 2/1991 | Baggs | 84/723 |
| 5,460,072 | A | 10/1995 | Ferdon | |
| 7,462,767 | B1 * | 12/2008 | Swift | 84/291 |
| 7,687,696 | B2 * | 3/2010 | Fox | 84/290 |
| 8,648,238 | B1 * | 2/2014 | Trabits | 84/298 |
| 2008/0190263 | A1 | 8/2008 | Drew | |

* cited by examiner

*Primary Examiner* — Jianchun Qin

(57) ABSTRACT

The present invention is a bridge truss that alleviates tensile and compressive stresses applied to an acoustic stringed instruments soundboard from the bridge. These tensile and compressive stresses are transferred through the bridge truss to chamber of the acoustic stringed instrument instead. The bridge truss allows the support brace of the acoustic stringed instrument to be reduced or eliminated. The bridge truss provides the soundboard with the ability to produce longer sustained vibrations, and vibrations of greater amplitude—increasing performance and tone. Also, the relative height of the soundboard can be altered for greater playability, at a user's discretion. A user only needs to reposition threaded adjustment rods from atop the bridge of the acoustic stringed instrument in order to transfer more or less stress to the bridge truss.

9 Claims, 9 Drawing Sheets

ACOUSTIC STRINGED INSTRUMENT BRIDGE TRUSS

CROSS-REFERENCE TO RELATED APPLICATIONS

The current application claims a priority to the U.S. Provisional Patent Application Ser. No. 61/583,514 filed on Aug. 9, 2013.

FIELD OF THE INVENTION

The present invention relates generally to an apparatus for a bridge truss. More specifically, the apparatus is a bridge truss to redistribute portions of stress induced by tension of strings on an acoustic stringed instrument when tuned to standard pitch.

BACKGROUND OF THE INVENTION

In a musical stringed instrument such as an acoustic guitar, a sound is created from the vibration of strings. This vibration generates tremendous stress on the soundboard of the guitar; more specifically, through vibrations induced by the bridge. The strings of the guitar also apply high amounts of tension to the soundboard. The bridge of the guitar is often glued onto the soundboard, and the soundboard is support by a brace. Most guitars implement an X-brace type of support brace. This is located opposite to the bridge. Also, a bridge plate is attached to the soundboard directly below the bridge. The strings of the instrument are threaded through the bridge plate, the soundboard, and the bridge. Tension in the strings pulls upward on the bridge plate, ultimately inducing stress in the soundboard. The tension increases as the strings are tuned to match a specific note. This action oftentimes causes warping and unwanted stress on the soundboard. Moreover, such tension is alleviated by the support brace (X-brace). However, these support braces can reduce the amount of vibration of the soundboard on the guitar and produce a less desirable sound quality. It is therefore an object of the present invention to introduce a bridge truss to distribute pressure caused by tension of strings on the stringed instrument in order to allow a lighter support brace (X-brace) to be constructed. By stabilizing the soundboard with the bridge truss, the present invention is able to nearly eliminate the stringed instruments requirement of a support brace. Therefore, bracing the soundboard with the bridge truss should produce a fuller sound and greater tone when the strings are tuned and played.

DETAIL DESCRIPTIONS OF THE INVENTION

Figure 1:
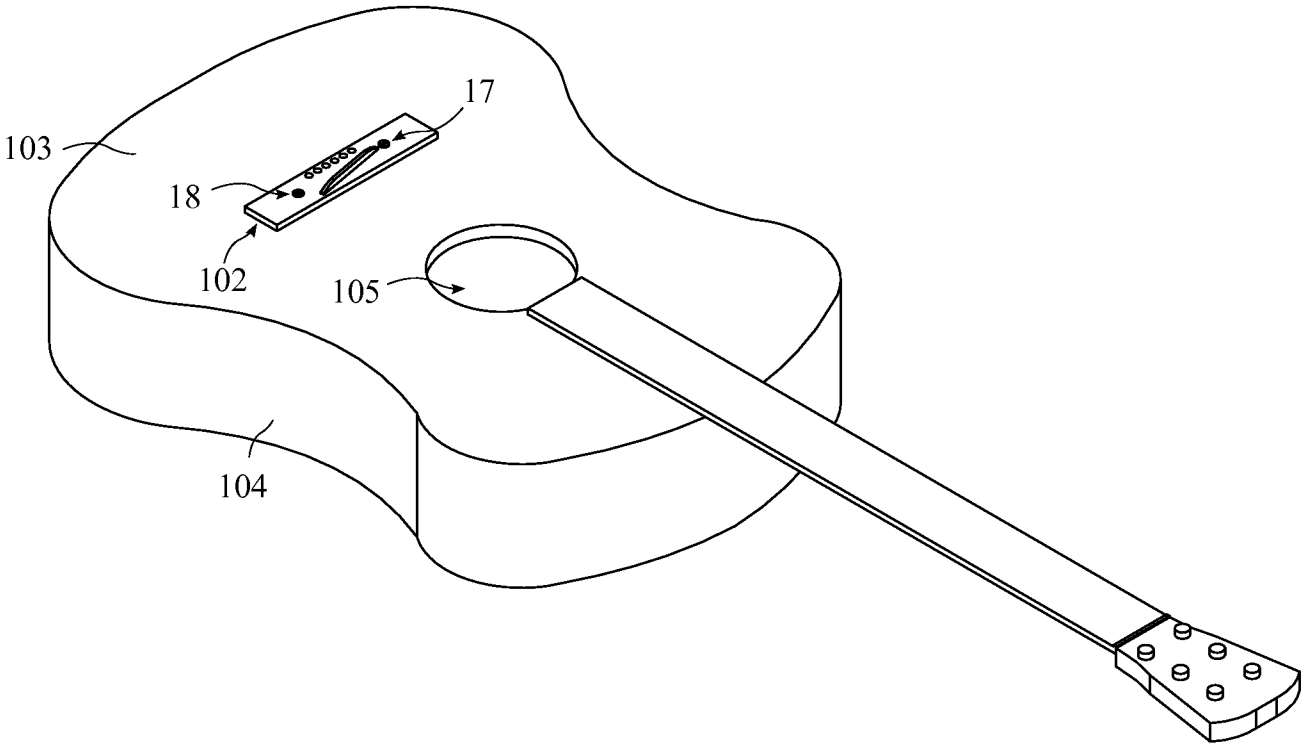
FIG. 1 is a perspective view of a stringed instrument with the present invention installed.
Figure 2:
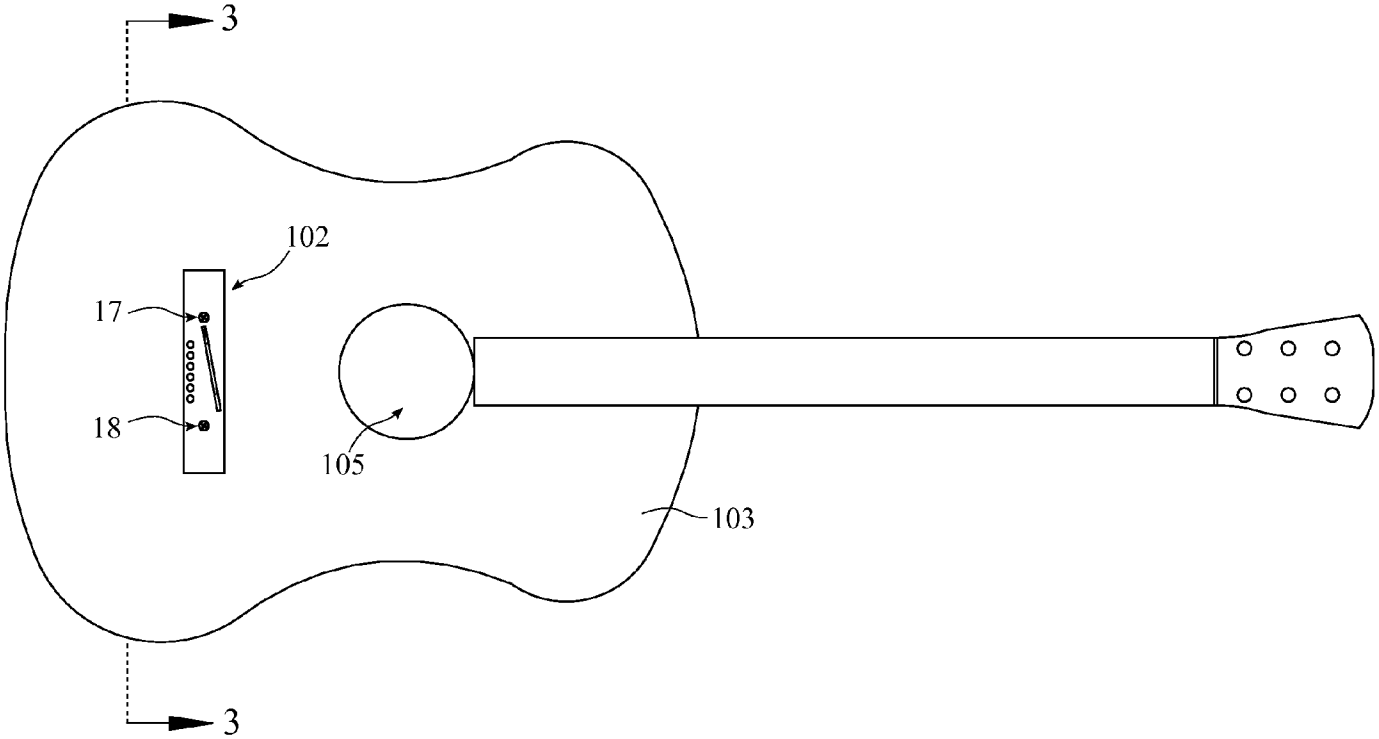
FIG. 2 is a top view of a stringed instrument with the present invention installed, showing the plane 2-2 in which a cross section is taken.

All illustrations of the drawings are for the purpose of describing selected versions of the present invention and are not intended to limit the scope of the present invention.

As shown in FIG. 1-FIG. 9, the present invention is a bridge truss 1 for use with acoustic stringed instrument 101*s*. Typically, an acoustic stringed instrument 101, shown in FIG. 1-FIG. 5, comprises a bridge 102, a soundboard 103, a chamber 104, a chamber cavity 105, and a support brace 106. The chamber 104 attaches to the soundboard 103 in which the chamber cavity 105 is housed between the chamber 104 and the soundboard 103. The bridge 102 is attached atop the soundboard 103, oppositely to the chamber cavity 105. The support brace 106 is often attached to the soundboard 103 and the chamber 104 within the chamber cavity 105. Strings are threaded through the soundboard 103 and the bridge 102 and are fixed to a rigid end of the acoustic stringed instrument 101 that is usually not connected to the soundboard 103. Oftentimes, these stringed instruments 101 include a bridge plate that is attached to the soundboard 103 within the chamber cavity 105 and positioned directly beneath the bridge 102. Such bridge plates absorb the pressure applied by the strings to the soundboard 103. As a string vibrates, so does the soundboard 103. This causes the sound to be amplified within the chamber cavity 105 and then projected outwards. The strings need to be tensioned in order to be audible and in order to produce the correct pitch. This tension pulls the bridge 102 upwards from the soundboard 103, which induces stress into the soundboard 103. Most acoustic stringed instruments 101 implement a saddle that is comprised by the bridge 102. The function of the saddle is to raise the height of the strings from the soundboard 103. The strings compress the saddle into the soundboard 103. The dual combination of tensile and compressive forces being applied to the soundboard 103 requires the support brace 106 to be quite rigid in order to maintain the integrity of the soundboard 103. Although the support brace 106 maintains an equal distribution of stress within the soundboard 103, the support brace 106 also dampens the vibration of the soundboard 103. This limits the performance, especially the tone, of the acoustic stringed instrument 101. The present invention allows the soundboard 103 of an acoustic stringed instrument 101 to sustain longer vibrations and/or vibrations of greater amplitude, providing a greater tone—nearly eliminating the instrument's need of the support brace 106. This is achieved by implementing a bridge truss 1 that redistributes the tensile and compressive forces applied to the soundboard 103, particularly by the strings and the bridge 102.

The present invention is a bridge truss 1 that is be installed during the construction of the stringed instrument 101; however, the bridge truss 1 can be installed into a pre-existing stringed instrument 101 as a useful improvement. In the preferred embodiment of the present invention, the bridge truss 1 comprises a truss compression rod 2, a truss wire, a plurality of truss mounts 4, a plurality of truss mount rods 5, a plurality of threaded adjustment rods 6, a plurality of adjustment rod mounts 7, a plurality of adjustment rod wires 8, a plurality of wire grommets 9, and a plurality of chamber support rods 10. The plurality of truss mounts 4 further comprises a first truss mount 13 and a second truss mount 14; however any number of truss mounts 4 could be used. The plurality of truss mount rods 5 further comprises a first truss mount rod 15 and a second trust mount rod; however, any number of truss mount rods 5 could be used. The plurality of threaded adjustment rods 6 further comprises a first threaded adjustment rod 17 and a second threaded adjustment rod 18; however, any number of threaded adjustment rods 6 could be used. The plurality of adjustment rod mounts 7 further comprises a first adjustment rod mount 19 and a second adjustment rod mount 20; however, any number of adjustment rod mounts 7 could be used. The plurality of adjustment rod wires 8 further comprises a first adjustment rod wire 21 and a second adjustment rod wire 22; however, any number of adjustment rod wires 8 could be used. The plurality of wire grommets 9 further comprises a first wire grommet 23 and a second wire grommet 24; however any number of wire grommets 9 could be used.

The function of the plurality of truss mounts 4 is to anchor the bridge truss 1 within the chamber 104. A portion of the stress is redistributed from the bridge 102 to the plurality of truss mounts 4, rather than entirely from the bridge 102 to the support brace 106. The weight, or overall mass, of most materials is directly proportional to the level of stress that they are able to endure before failure. Therefore, the support brace 106 can be lightened to account for the lowering of stress levels within its structure. In the preferred embodiment of the present invention, the truss mounts 4 are wooden blocks because these provide high strength while being of relatively low density, hence less weight; however, the present invention should not be limited by wooden blocks and any mounting material or devices that function similar could be used. The plurality of truss mounts 4 are housed within the chamber cavity 105. Both the first truss mount 13 and the second trust mount 14 are secured to the chamber 104. This could be done through adhesives, anchors, or any similarly functioning existing or future technology. Also, both the first truss mount 13 and the second truss mount 14 should be connected to the truss compression rod 2. The first truss mount 13 should be positioned oppositely to the second truss mount 14, within the chamber cavity 105. The truss compression rod 2 functions by maintaining an equal stress distribution through the bridge truss 1 to the plurality of truss mounts 4. Typically, the first truss mount 13 and the second truss mount 14 should have a tendency to pull inwards, towards each other; the truss compression rod 2 prevents this action by absorbing the force and remaining rigid. However, if the first truss mount 13 and the second truss mount 14 have a tendency to pull outwards, away from each other, then a truss tension rod should be implemented instead of the truss compression rod 2 for as long as this truss tension rod keeps both the first truss 13 mount and the second truss mount 14 rigidly secured in place.

The truss wire 3 functions as the medium between the each of the plurality of truss mounts 4 and the bridge 102. The truss wire further comprises a first truss wire end 11 and second truss wire end 12. The truss wire 3 is attached to plurality of truss mounts 4 through the plurality of truss mount rods 5. The first truss wire end 11 should be attached to the first trust mount rod 15, while the second truss wire end 12 should be attached to the second truss mount rod 16. In the preferred embodiment of the present invention, each of the plurality of truss mount rods 5 is a threaded screw with an eyehole in which the truss wire can be threaded through. The first truss mount rod 15 should be screwed into the first truss mount 13, and the second truss mount rod 16 should be screwed into the second truss mount 14. However, either the first truss mount rod 15 could be attached to the first truss mount 13, or the second truss mount rod 16 could be attached to the second truss mount 14 through any similar existing or future attachment methods.

Figure 3:
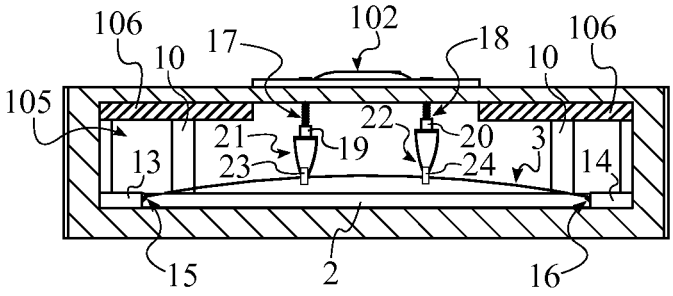
FIG. 3 is the cross section taken along the plane 2-2.
Figure 4:
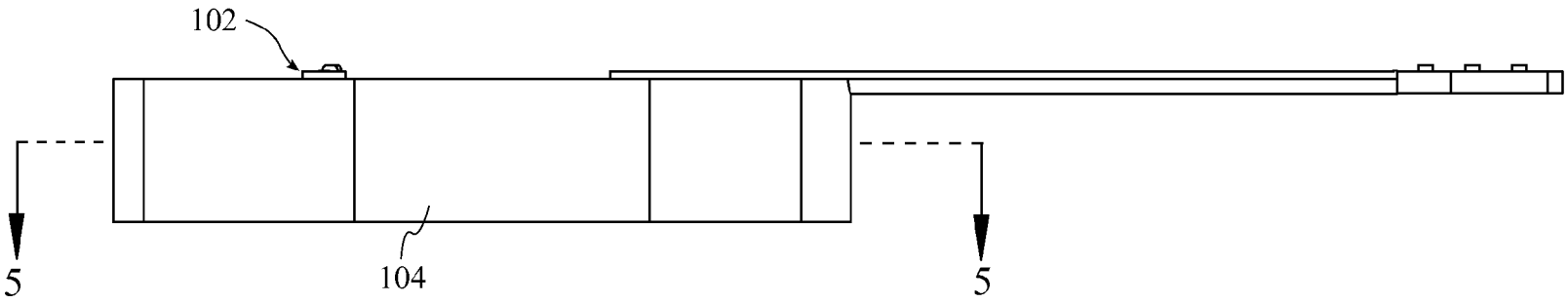
FIG. 4 is a side view of a stringed instrument with the present invention installed, showing the plane 4-4 in which a cross section is taken.
Figure 5:
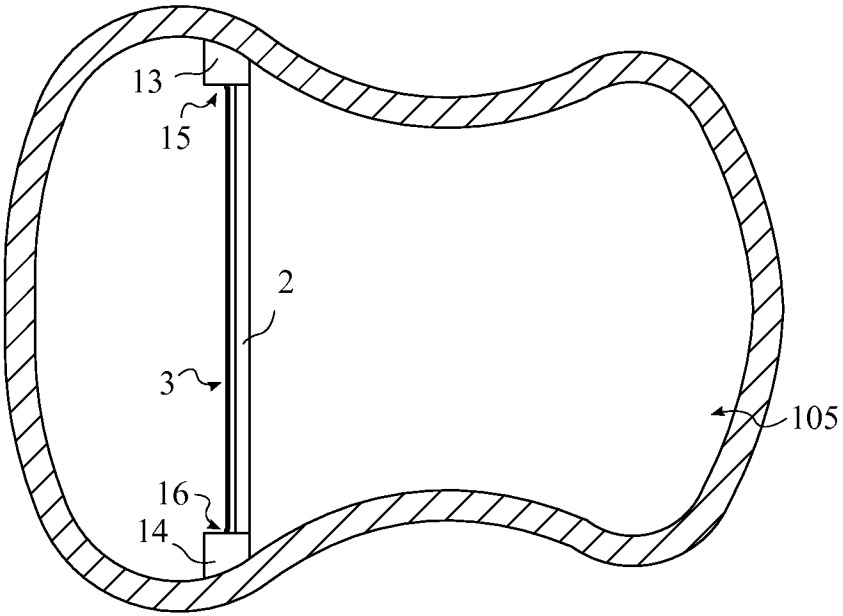
FIG. 5 is the cross section taken along the plane 4-4.
Figure 6:
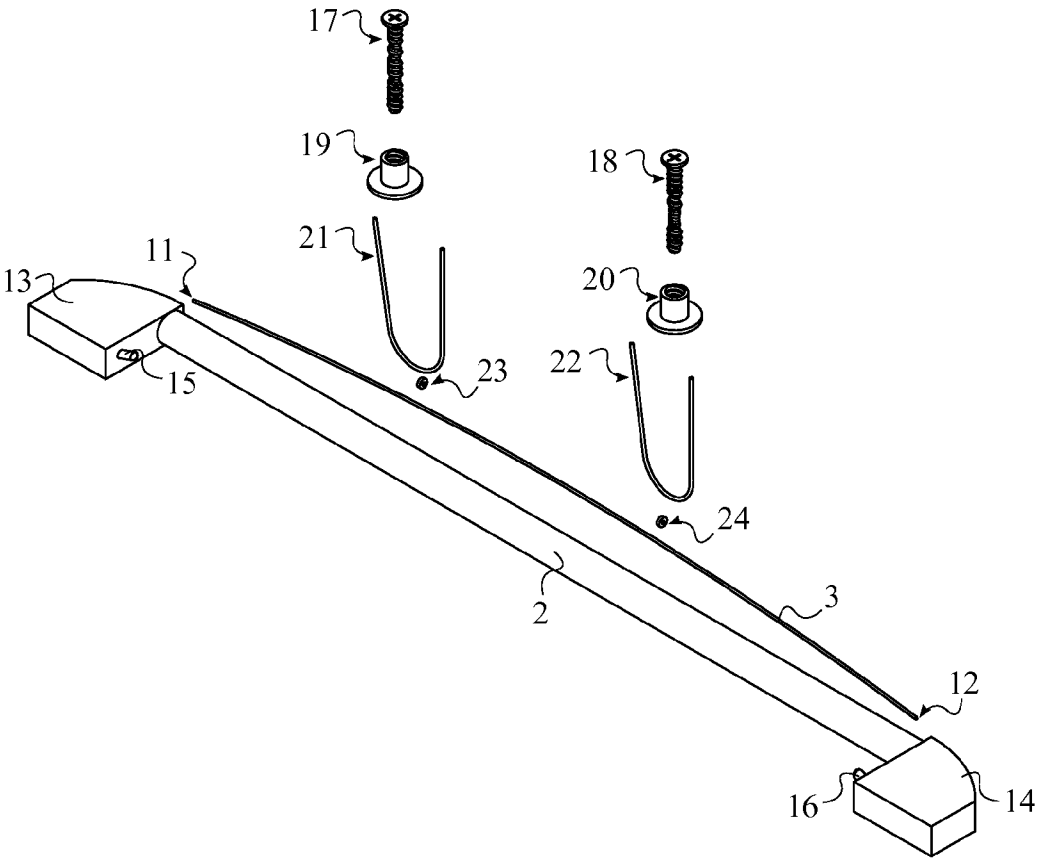
FIG. 6 is an exploded perspective view of the preferred embodiment of the bridge truss.

The truss wire 3 should also be threaded through both the first wire grommet 23 and the second wire grommet 24. Also, the first wire grommet 23 should be attached to the first adjustment rod mount 19, and the second wire grommet 24 should be attached to the second adjustment rod mount 20. The plurality of wire grommets 9 allow truss wire to freely traverse through. Allowing the truss wire to freely traverse through the grommet makes it possible for the bridge truss 1 to be adjusted or repositioned so that a user can optimally distribute stress from the bridge 102 to the chamber 104. Also, the attachment of the adjustment rod wires 8 to the adjustment rod mounts 7 should prevent the adjustment rod mounts 7 to rotate. A double loop, as is shown in FIG. 3, is the preferred attachment method.

The plurality of adjustment rod mounts 7 and the plurality of threaded adjustment rods 6 provide the ability of the bridge truss 1 to transfer more or less stress to the bridge truss 1 from the tension in the bridge 102, in which the stress level can be set by the user. Both the first adjustment rod mount 19 and the second adjustment rod mount 20 include a female threaded tubular portion. The first threaded adjustment rod 17 should traverse through the first adjustment rod mount 19. The male threaded portion of the threaded adjustment rods 6 should engage with the female threaded portion of the adjustment rod mounts 7. This allows both the first threaded adjustment rod 17 and the second threaded adjustment rod 18 to remain rigidly interlocked within the adjustment rod mounts 7. The positioning of the first threaded adjustment rod 17 within the first adjustment rod mount 19 should be able to be altered simply by rotating the first threaded adjustment rod 17; concurrently, the second threaded adjustment rod 18 and the second adjustment rod mount 20 should behave similarly.

Through the connection between the adjustment rod mounts 7 and the adjustment rod wires 8, if both the first threaded adjustment rod 17 and the second threaded adjustment rod 18 are repositioned outwards from the soundboard 103, the truss wire should be pulled upwards in the same direction. This means that the truss compression rod 2 would experience higher stress levels. If lower stress levels are desired, then the plurality of threaded adjustment rods 6 should be repositioned, or inserted, further into the chamber cavity 105, though the soundboard 103. Depending upon a user's preference, the stress level absorbed by the bridge truss 1 could differ.

The plurality of chamber support rods 10 are affixed to both the chamber 104 and the support brace 106. The function of the plurality of chamber support rods 10 is to prevent the soundboard 103 from bowing due to new stress distributions within the structure of the soundboard 103. These chamber support rods 10 are integral to the effectiveness of the bridge truss 1, and the structural soundness of the acoustic stringed instrument 101. An objective of the present invention is to lessen the requirement of a support brace 106 (X-brace for most guitars) by lightening the support brace 106. However, the soundboard 103 still needs to be supported to prevent bowing and other undesired flexural reactions. The chamber support rods 10 keep the soundboard level, so that the overall rigidity of the stringed instrument 101 can be maintained.

The present invention can implement a force measuring gauge. This force measuring gauge should be able to measure the transfer of tensile or compressive forces from the bridge 102 to the bridge truss 1. A user may feel that a particular tensile force level is the most effective in harnessing the fullest amount of tone could from their acoustic stringed instrument 101. The force measuring gauge should also be able to alert the user if the levels of force being transferred are too high or too low—each stringed instrument 101 may have dissimilar performance limits.

By relieving the soundboard 103 of tensile or compressive forces induced by the bridge 102 should allow the lightening, or even elimination (if applicable), of the support brace 106. The preferred method of lightening the support brace 106 is to remove mass from a standard support brace 106. For example, the support brace 106 of most acoustic guitar is an X-brace. Then this X-brace can be lightened by being sanded, shaved down, etc. Ultimately the X-brace is lightened by having material mass removed from its structure. This should enhance the performance and provide a greater tone to the acoustic guitar if X-brace is lightened and the bridge truss 1 is implemented.

A user can adjust the action and playability of the acoustic string instrument 101 by repositioning the threaded adjustment rods 6. This allows the soundboard 103 to adjust up or down, changing the height of the strings from the fret board.

Figure 7:
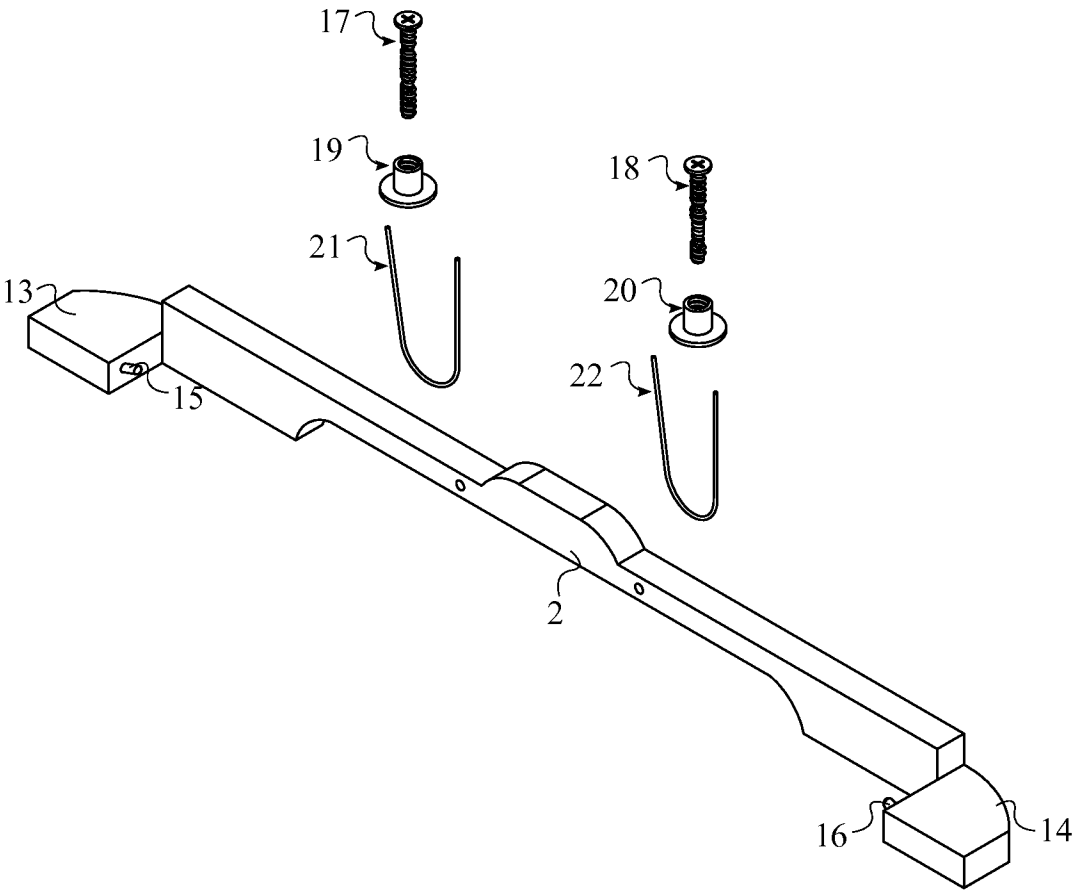
FIG. 7 is an exploded perspective view of an alternative embodiment of the bridge truss.
Figure 8:
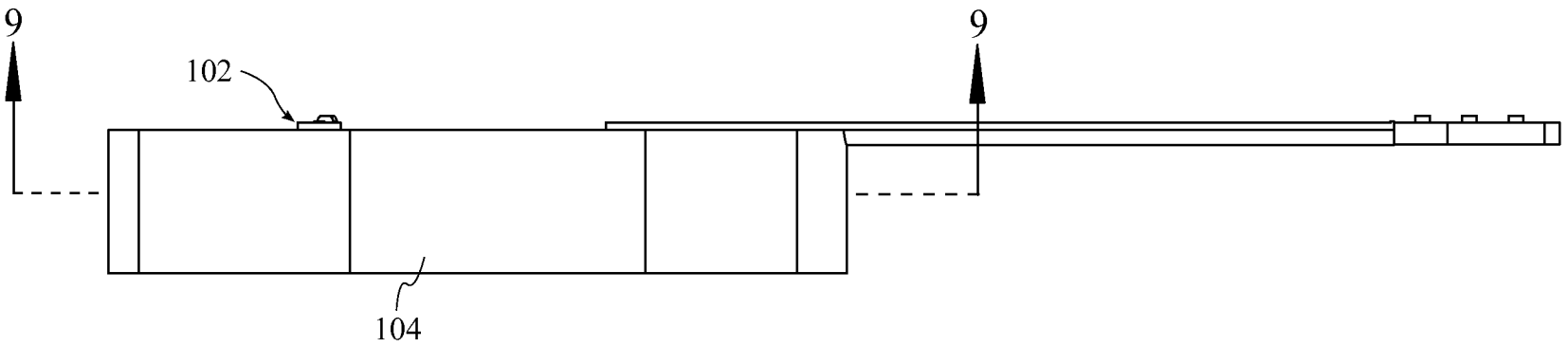
FIG. 8 is a side view of a stringed instrument with the present invention installed, showing the plane 8-8 in which a cross section is taken.
Figure 9:
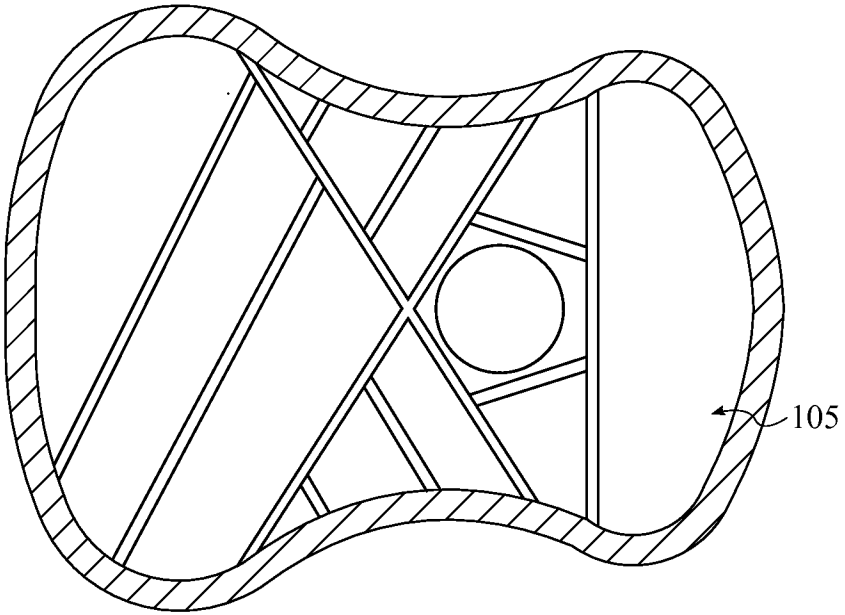
FIG. 9 is the cross section taken along the plane 8-8.

As is shown in FIG. 7, an alternative embodiment of the present invention implements a bridge truss 1 without the truss wire 3 and the plurality of wire grommets 9. The truss compression rod 2 should include a plurality of holes that function as the plurality wire grommets 9. Including holes within the truss compression rod 3 eliminates the need of truss wire 3 in the bridge truss 1.

Although the invention has been explained in relation to its preferred embodiment, it is to be understood that many other possible modifications and variations can be made without departing from the spirit and scope of the invention as hereinafter claimed.

What is claimed is:

1. A stringed instrument integrated with a bridge truss, comprising:

a stringed instrument;

said stringed instrument comprising a bridge;

a bridge truss;

said bridge truss comprising a plurality of truss mounts;

said bridge truss being mounted onto said stringed instrument with said plurality of truss mounts;

said bridge truss being below said bridge;

said bridge truss further comprising a truss compression rod, a truss wire, a plurality of truss mount rods, a plurality of threaded adjustment rods, a plurality of adjustment rod mounts, a plurality of adjustment rod wires, a plurality of wire grommets, and a plurality of chamber support rods;

said plurality of truss mounts being connected to said truss compression rod;

said plurality of truss mounts comprising a first truss mount and a second truss mount;

said first truss mount being positioned oppositely to said second truss mount;

both said first truss mount and said second truss mount being secured to said chamber;

both said first truss mount and said second truss mount being positioned within said chamber cavity;

said truss wire comprising a first truss wire end and a second truss wire end;

said plurality of truss mount rods comprising a first truss mount rod and a second truss mount rod;

said plurality of wire grommets comprising a first wire grommet, and a second wire grommet;

said first truss wire end being positioned oppositely to said second truss wire end;

said truss wire being threaded through both said first wire grommet and said second wire grommet;

said plurality of threaded adjustment rods comprising a first threaded adjustment rod, and a second threaded adjustment rod;

said plurality of adjustment rod mounts comprising a first adjustment rod mount and a second adjustment rod mount;

said plurality of adjustment rod wires comprising a first adjust rod wire and a second adjustment rod wire;

said first adjustment rod mount being traversed by said first threaded adjustment rod;

said second adjustment rod mount being traversed by said first threaded adjustment rod mount;

said first adjustment rod wire being attached to both said first threaded adjustment rod mount and said first wire grommet;

said second adjustment rod wire being attached to both said second threaded adjustment rod mount and said second wire grommet;

said first truss wire end being attached to said first truss mount rod;

said second truss wire end being attached to said second truss mount rod;

said first truss mount rod being attached to said first truss mount;

said second truss mount rod being attached to said second truss mount;

said bridge being traversed said plurality of threaded adjustment rods;

said soundboard being traversed said plurality of threaded adjustment rods; and each of said plurality of chamber support rods being perpendicularly attached to said support brace.

2. The stringed instrument integrated with bridge truss as claimed in claim 1, comprising:

said stringed instrument further comprising a soundboard, a chamber, a chamber cavity, and a support brace.

3. The stringed instrument integrated with bridge truss as claimed in claim 2, comprising:

said chamber being attached to said soundboard;

said chamber cavity being positioned between said chamber and said soundboard;

said soundboard and said chamber being supported by said support brace; and said bridge being attached atop said soundboard, opposite to said chamber cavity.

4. The stringed instrument integrated with bridge truss as claimed in claim 1, further comprising:

a force measuring gauge.

5. A stringed instrument integrated with a bridge truss, comprising:

a stringed instrument;

said stringed instrument comprising a bridge;

a bridge truss;

said bridge truss comprising a plurality of truss mounts;

said bridge truss being mounted onto said stringed instrument with said plurality of truss mounts;

said bridge truss being below said bridge; and a force measuring gauge;

said bridge truss further comprising a truss compression rod, a truss wire, a plurality of truss mount rods, a plurality of threaded adjustment rods, a plurality of adjustment rod mounts, a plurality of adjustment rod wires, a plurality of wire grommets, and a plurality of chamber support rods;

said plurality of truss mounts being connected to said truss compression rod;

said plurality of truss mounts comprising a first truss mount and a second truss mount;

said first truss mount being positioned oppositely to said second truss mount;

both said first truss mount and said second truss mount being secured to said chamber;

both said first truss mount and said second truss mount being positioned within said chamber cavity;

said bridge being traversed said plurality of threaded adjustment rods;

said soundboard being traversed said plurality of threaded adjustment rods; and each of said plurality of chamber support rods being perpendicularly attached to said support brace.

6. The stringed instrument integrated with bridge truss as claimed in claim 5, comprising:

said stringed instrument further comprising a soundboard, a chamber, a chamber cavity, and a support brace;

said chamber being attached to said soundboard;

said chamber cavity being positioned between said chamber and said soundboard;

said soundboard and said chamber being supported by said support brace; and said bridge being attached atop said soundboard, opposite to said chamber cavity.

7. The stringed instrument integrated with bridge truss as claimed in claim 5, comprising:

said truss wire comprising a first truss wire end and a second truss wire end;

said plurality of truss mount rods comprising a first truss mount rod and a second truss mount rod;

said plurality of wire grommets comprising a first wire grommet, and a second wire grommet;

said first truss wire end being positioned oppositely to said second truss wire end;

said truss wire being threaded through both said first wire grommet and said second wire grommet;

said first truss wire end being attached to said first truss mount rod;

said second truss wire end being attached to said second truss mount rod;

said first truss mount rod being attached to said first truss mount; and said second truss mount rod being attached to said second truss mount.

8. The stringed instrument integrated with bridge truss as claimed in claim 7, comprising:

said plurality of threaded adjustment rods comprising a first threaded adjustment rod, and a second threaded adjustment rod;

said plurality of adjustment rod mounts comprising a first adjustment rod mount and a second adjustment rod mount;

said plurality of adjustment rod wires comprising a first adjust rod wire and a second adjustment rod wire;

said first adjustment rod mount being traversed by said first threaded adjustment rod;

said second adjustment rod mount being traversed by said first threaded adjustment rod mount;

said first adjustment rod wire being attached to both said first threaded adjustment rod mount and said first wire grommet; and said second adjustment rod wire being attached to both said second threaded adjustment rod mount and said second wire grommet.

9. A stringed instrument integrated with a bridge truss, comprising:

a stringed instrument;

said stringed instrument comprising a bridge;

a bridge truss;

said bridge truss comprising a plurality of truss mounts;

said bridge truss being mounted onto said stringed instrument with said plurality of truss mounts;

said bridge truss being below said bridge;

a force measuring gauge;

said stringed instrument further comprising a soundboard, a chamber, a chamber cavity, and a support brace;

said chamber being attached to said soundboard;

said chamber cavity being positioned between said chamber and said soundboard;

said soundboard and said chamber being supported by said support brace;

said bridge being attached atop said soundboard, opposite to said chamber cavity;

said chamber being attached to said soundboard;

said chamber cavity being positioned between said chamber and said soundboard;

said soundboard and said chamber being supported by said support brace;

said bridge being attached atop said soundboard, opposite to said chamber cavity;

said bridge truss further comprising a truss compression rod, a truss wire, a plurality of truss mount rods, a plurality of threaded adjustment rods, a plurality of adjustment rod mounts, a plurality of adjustment rod wires, a plurality of wire grommets, and a plurality of chamber support rods;

said plurality of truss mounts being connected to said truss compression rod;

said plurality of truss mounts comprising a first truss mount and a second truss mount;

said first truss mount being positioned oppositely to said second truss mount;

both said first truss mount and said second truss mount being secured to said chamber;

both said first truss mount and said second truss mount being positioned within said chamber cavity;

said bridge being traversed said plurality of threaded adjustment rods;

said soundboard being traversed said plurality of threaded adjustment rods;

each of said plurality of chamber support rods being perpendicularly attached to said support brace;

said truss wire comprising a first truss wire end and a second truss wire end;

said plurality of truss mount rods comprising a first truss mount rod and a second truss mount rod;

said plurality of wire grommets comprising a first wire grommet, and a second wire grommet;

said first truss wire end being positioned oppositely to said second truss wire end;

said truss wire being threaded through both said first wire grommet and said second wire grommet;

said first truss wire end being attached to said first truss mount rod;

said second truss wire end being attached to said second truss mount rod;

said first truss mount rod being attached to said first truss mount;

said second truss mount rod being attached to said second truss mount;

said plurality of threaded adjustment rods comprising a first threaded adjustment rod, and a second threaded adjustment rod;

said plurality of adjustment rod mounts comprising a first adjustment rod mount and a second adjustment rod mount;

said plurality of adjustment rod wires comprising a first adjust rod wire and a second adjustment rod wire;

said first adjustment rod mount being traversed by said first threaded adjustment rod;

said second adjustment rod mount being traversed by said first threaded adjustment rod mount;

said first adjustment rod wire being attached to both said first threaded adjustment rod mount and said first wire grommet; and said second adjustment rod wire being attached to both said second threaded adjustment rod mount and said second wire grommet.

* * * * *